United States Patent [19]

Zenner

[11] 4,248,147

[45] Feb. 3, 1981

[54] CONTROL SYSTEM FOR DOT MATRIX LINE PRINTER USING ONE PRINT ELEMENT PER CHARACTER

[76] Inventor: Walter J. Zenner, 10801 Highway E-R-3, Mukwonago, Wis. 53149

[21] Appl. No.: 34,645

[22] Filed: Apr. 30, 1979

[51] Int. Cl.[3] ..... B41J 3/12

[52] U.S. Cl. ..... 101/93.05; 400/124

[58] Field of Search ..... 400/121, 124; 101/93.04, 93.05

[56] References Cited

U.S. PATENT DOCUMENTS

| | | | |
|---|---|---|---|
| 3,802,544 | 4/1974 | Howard et al. | 400/124 |
| 4,159,882 | 7/1979 | Sanders et al. | 400/124 |

*Primary Examiner*—Paul T. Sewell

*Attorney, Agent, or Firm*—Kinzer, Plyer, Dorn & McEachran

[57] ABSTRACT

A control system for a dot matrix line printer having one print element for each character position on the line; a single-line memory stores the data words for a line of characters and those data words are supplied to a character signal generator sequentially to print the dots for an initial matrix position in a c×r matrix for all characters, whereupon the print elements are shifted one column increment along the print line. This procedure is repeated for each dot matrix position, the record sheet being advanced one row increment each time c column positions have been printed. After completion of c·r scans, printing of a full line of characters is complete, the single-line memory is cleared, and the process is started again for the next line of characters, after a line-space feed of the record sheet.

6 Claims, 5 Drawing Figures

(5x7 MATRIX, C=5, r=7)

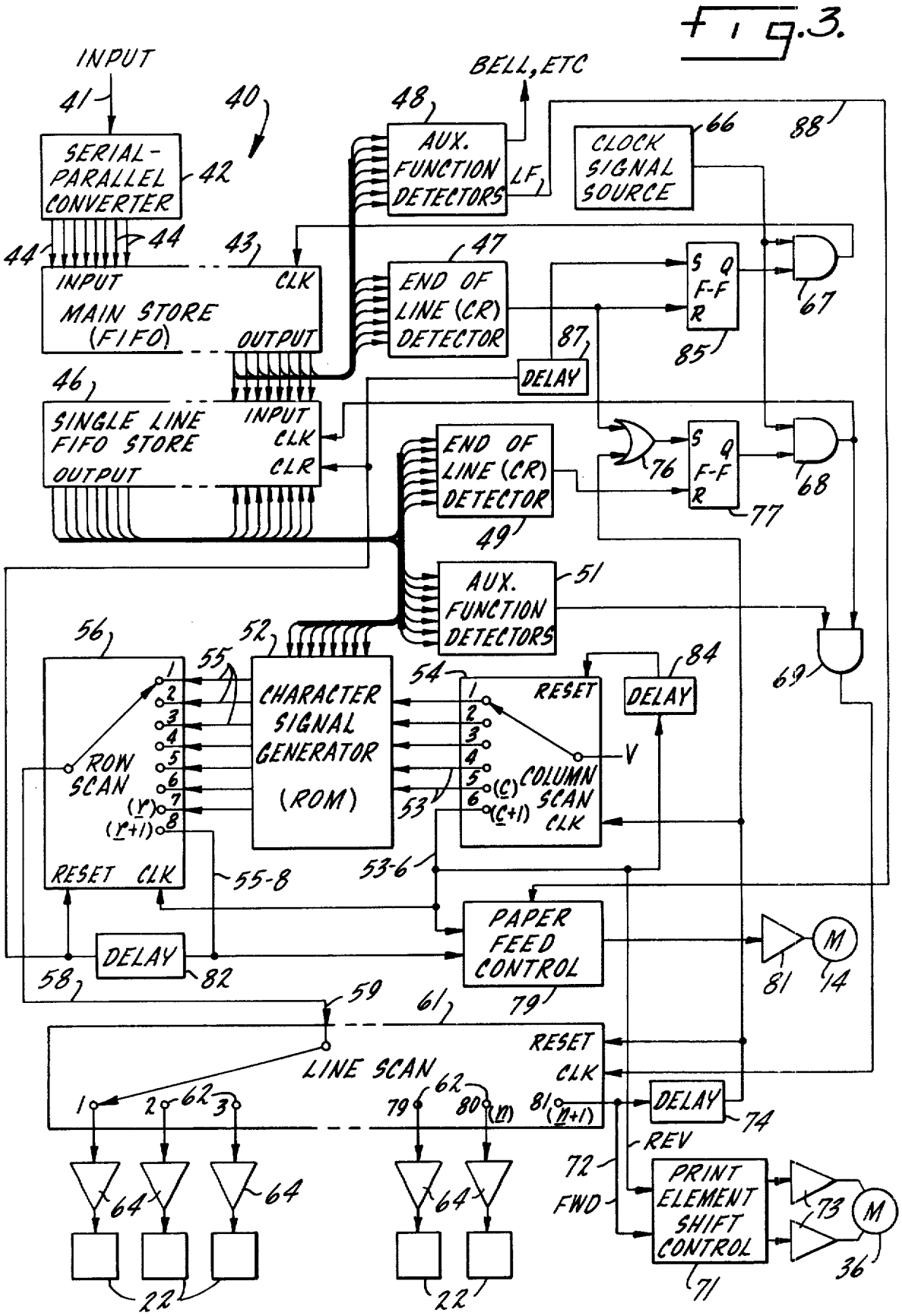
Fig. 3.
INPUT
41
40
SERIAL-PARALLEL CONVERTER
42
44
44
43
INPUT
CLK
MAIN STORE (FIFO)
OUTPUT
46
SINGLE LINE FIFO STORE
INPUT
CLK
CLR
OUTPUT
48
AUX. FUNCTION DETECTORS
BELL, ETC
LF
CLOCK SIGNAL SOURCE
66
88
47
END OF LINE (CR) DETECTOR
S Q F-F R
67
85
87
DELAY
END OF LINE (CR) DETECTOR
76
S Q F-F R
68
77
49
AUX. FUNCTION DETECTORS
51
69
56
52
55
CHARACTER SIGNAL GENERATOR (ROM)
54
RESET
DELAY
84
ROW SCAN
(r)
(r+1)
RESET CLK
COLUMN SCAN CLK
(c)
(c+1)
V
53
55-8
53-6
PAPER FEED CONTROL
DELAY
82
58
59
61
79
81
14
M
RESET
CLK
LINE SCAN
62
DELAY
74
REV
72
FWD
PRINT ELEMENT SHIFT CONTROL
73
M
36
71
64
22

CONTROL SYSTEM FOR DOT MATRIX LINE PRINTER USING ONE PRINT ELEMENT PER CHARACTER

BACKGROUND OF THE INVENTION

Most dot matrix printers utilize a print head mounted on a carriage that is moved across the paper or other record sheet to print a line of characters. In some instances, the print head provides a complete array of print rods or other print elements, one for each position in the dot matrix; in others there is just one column of print elements and each character is reproduced by a series of column-increment steps of the print head. These printers are somewhat limited in speed of operation because the print head must be stepped completely across the record sheet to reproduce each line of characters. In addition, printers of this type have inherent acceleration and deceleration problems, which increase markedly for high print rates and which lead to difficulties in maintaining adequate quality in the reproduced characters.

Dot matrix line printers are also known in the art. A dot matrix line printer may provide a full complement of print elements at each character position along the line. Alternatively, there may be a single column of print elements for each character position, the print elements being shifted horizontally through a series of column-increment steps, corresponding to the number of columns in the dot matrix, in printing each line. For these printers, however, particularly when print rods or other impact print elements are employed, costs may be inordinately high due to the large number of print elements and print element actuators involved. Thus, for a conventional line of eighty characters, using a complete set of print elements for a simple 5×7 matrix at each character position, there are twenty-eight hundred print elements, each requiring its own actuator. For a line printer having only a single column of print elements at each character position, the eighty-character line requires five hundred sixty print elements and five hundred sixty actuators, still an excessive number.

Another form of dot matrix line printer uses just one print element per character position. The economy of construction is obvious; only eighty print elements and eighty actuators are required to print a complete line of text. A dot matrix line printer of this general kind is described in Howard et al U.S. Pat. No. 3,802,544, issued Apr. 4, 1974, which constitutes the most pertinent prior art known to the inventor relative to the present invention. This type of printer, however, presents substantial difficulties with respect to the control system that supplies the requisite dot print signals to the print element actuators and that controls relative movements between the print elements and the record sheet.

Thus, in the Howard et al printer the print elements are continuously cyclically moved parallel to the print line, first in a forward (left-to-right) direction and then in a reverse direction, that cyclical movement spanning all of the column positions of the matrix. The data words representative of one full line of print are initially translated, by a character signal generator, for one dot position in the matrix, to develop eighty dot position signals that are recorded in a buffer register. When the print elements are aligned with the first position (column one, row one) in the matrix, all of the dots for all characters are printed for that position. Before the print elements reach the next column position in the first row, the data words are again translated to provided a new set of dot position signals in the buffer register so that all of the dots or the second matrix position can again be printed simultaneously. This process is repeated for each column of the matrix to finish the first row, after which the print elements are cycled back in the reverse direction without printing and the procedure is again repeated for each column position in the second row of the matrix. The record sheet is inclined slightly to the line of the print elements and is advanced continuously to afford the requisite spacing between matrix rows. Thus, the control system must coordinate continuous movements of the print elements and the record sheet and the application of signals to the print element actuators through a total of thirty-five individual steps in printing one line of characters, when using a 5×7 matrix. For a larger matrix (e.g. 7×9) the number of steps is, of course, much larger.

Coordination and timing in the system of the Howard et al patent is achieved by a series of countdown circuits supplied from a clock source that actuates a register having a storage capacity of one line of characters. This presents the possibility that, if any one of the several countdown circuits misses a single count, an entire line of characters can be distorted. At the same time, if the separate drives for the record sheet and the print elements are the least bit out of synchronism with the print element actuator controls, substantial distortion of the characters may be experienced. Thus, there is a distinct need for a positive control system for a dot matrix line printer of this general kind, a control system that affords positive control of each of the thirty-five or more stages in the printing of the line of characters such that is any single operation occurs asynchronously, subsequent operations will automatically return to synchronization. Further, there is a need for positive control of the physical movements of the print elements and the record sheet to assure accurate location of the dot positions in the matrices that constitute the individual characters.

SUMMARY OF THE INVENTION

It is a principal object of the present invention, therefore, to provide a new and improved control system for a dot matrix line printer of the kind that employs one print element for each character position along the line.

Another object of the invention is to provide a new and improved control system for a dot matrix line printer of the type using one print element per character that affords improved accuracy of indexing movements of the print elements and the record sheet.

Another object of the invention is to provide a new and improved control system for a dot matrix line printer of the kind using one print element per character that affords positive control for each column and row movement and operation, such that accurate synchronization is assured at all times.

A related object of the invention is to provide a new and improved control system for a dot matrix line printer of the type using one print element per character that is simple and economical in construction yet highly reliable and accurate in operation and permits relatively high speed operation of the printer.

Accordingly, the invention relates to an improved control system for a dot matrix line printer that prints characters in a dot matrix of c columns and r rows, utilizing an input signal comprising a sequence of data words representing characters and auxiliary functions, the printer comprising n dot print elements aligned with a record sheet at n spaced character positions along a print line, n print element actuators, bidirectional column shift means for shifting the print elements forward and backward through a predetermined range of column positions along the print line, a clock signal source, single-line FIFO storage means for storing a series of data words representative of a line of n characters, a character signal generator, connected to the output of the single-line storage means, for translating each data word representative of a character into a r·c dot position signals, and row scan means and column scan means, connected to the character signal generator, for scanning the character signal generator to supply the dot position signals to a single output circuit in a predetermined line-row-column sequence. In the improved control system, the row scan means comprises a counter having r+1 effective stages, the column scan means comprises a counter having c+1 effective stages, and the column shift means comprises incremental shift means for shifting the print elements by predetermined discrete column width steps. The improved control system further comprises line scan means, comprising a counter having n+1 effective stages, for connecting the dot position signal output circuit to each print element actuator in line sequence; incremental sheet feed means for feeding the record sheet transversely to the print line in predetermined row width increments; line sequence control means for applying the clock signal to the signal-line storage means and the line scan means to actuate those means to read out data words in line sequence from the single-line storage means to the character signal generator in synchronism with advancement of the line scan means by one stage for each data word representative of a character; column scan control circuit means, connected to the line scan means, the column shift means, and the column scan means, for actuating those means to shift the print elements forward by one column increment, advance the column scan means one stage, and reset the line scan means each time the line scan means reaches an effective count of n+1; row scan control circuit means connected to the column scan means, the sheet feed means, the column shift means, and the row scan means, for actuating those means to advance the record sheet one row increment, shift the print elements backward to the initial column position, advance the row scan means one stage, and reset the column scan means each time the column scan means reaches an effective count of c+1; and line start control circuit means connected to the row scan means, the sheet feed means, and the single-line storage means, for actuating those means to advance the record sheet a predetermined number of row increments, clear the storage means, and reset the row scan means each time the row scan means reaches an effective count of r+1.

BRIEF DESCRIPTION OF THE DRAWINGS

FIG. 3 is a block diagram of a control system constructed in accordance with the invention.

DESCRIPTION OF THE PREFERRED EMBODIMENTS

Figure 1:
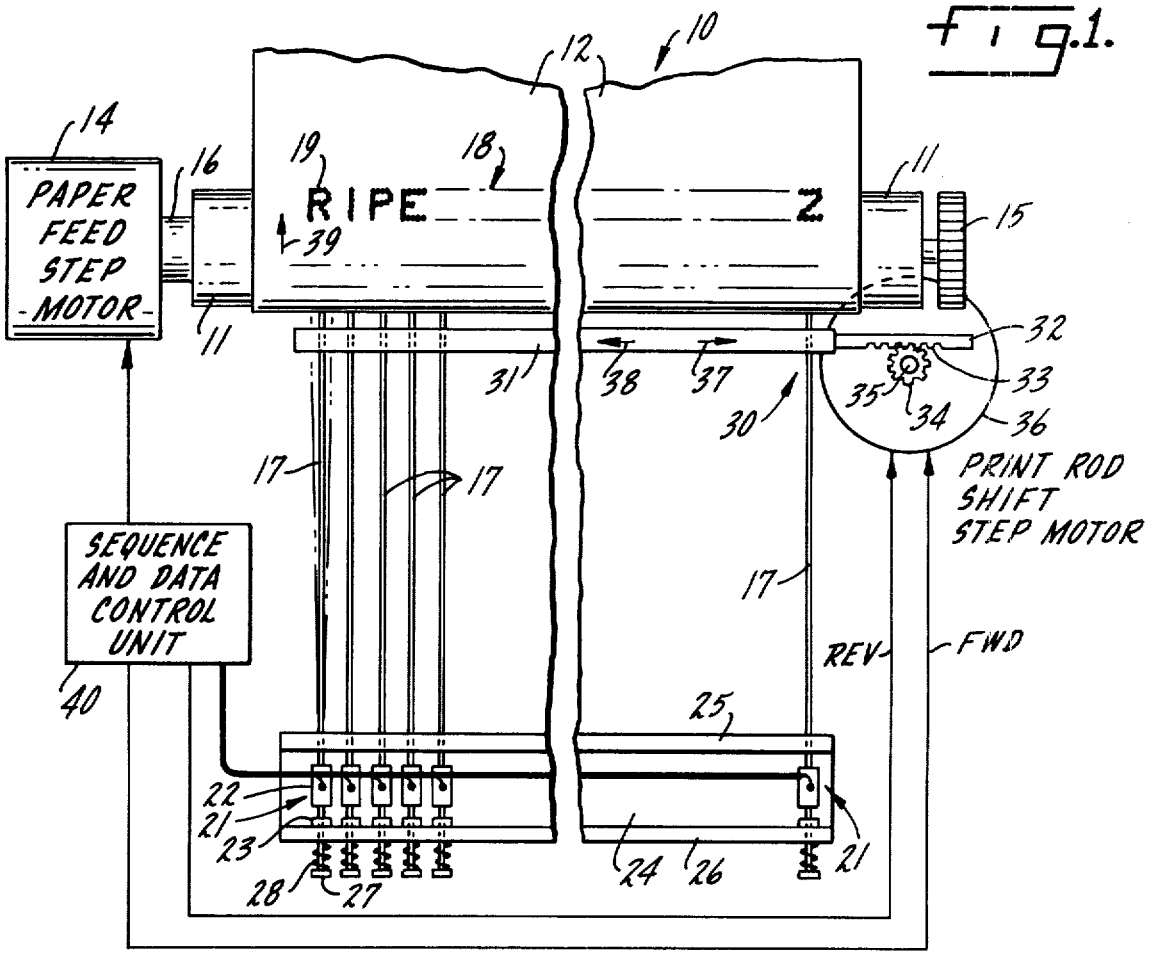
FIG. 1 is a simplified plan view of a dot matrix line printer in which the control system of the present invention is incorporated.

FIG. 1 illustrates a dot matrix line printer 10 of the kind that employs only one print element 17 for each character position on the line. Printer 10 includes a conventional roller platen 11 supporting a record sheet 12; in the illustrated arrangement, it is assumed that the record sheet 12 is an impact-sensitive paper. Record sheet 12 may constitute ordinary paper if printer 10 is equipped with a ribbon mechanism, or the record sheet may take some other form, depending on the kind of print elements used in the printer 10.

A paper feed step motor 14 is connected to platen 11 by a coupling 16. Step motor 14 is a part of incremental sheet feed means for feeding record sheet 12 by predetermined row width increments, as described more fully below. A knob 15 for manual rotation of platen 11 is provided at the opposite end of the platen.

Printer 10 is an impact printer in which the print elements comprise thin, relatively stiff, elongated print rods 17. There is one print rod 17 for each character position in a complete line of characters 18 extending across the record sheet 12. That is, printer 10 includes n print elements 17 aligned with record sheet 12 at spaced character positions along print line 18. Typically, in a printer employing a record sheet 12 with a width of 8.5 inches, the number n of character in each line 18 may be eighty; however, n can vary to a substantial extent, depending upon the width of the record sheet, the size of the individual characters 19, and other factors.

Each print element 17 has its own print actuator 21. In the illustrated construction, each print actuator 21 comprises an electromagnet 22 through which the print rod 17 extends. An armature 23 is secured to each print rod 17. The electromagnets 22 are mounted in a fixed frame 24 having a front wall 25 and a rear wall 26; each print rod 17 extends through suitable bearings in each of the walls 25 and 26. The extension of each print rod 17 beyond the rear wall 26 terminates at a collar 27, a biasing spring 28 being interposed between collar 27 and wall 26.

Printer 10 includes bidirectional column shift means 30 for shifting the outer ends of print elements 17 along the print line 18. The column shift means 30 includes an elongated print rod guide 31 that extends across printer 10 parallel to platen 11 and is spaced only a short distance from the platen. The outer end of each print rod 17 projects through a suitable bearing in guide member 31. An extension 32 of guide member 31 incorporates a rack 33 which engages a pinion 34 on the shaft 35 of a print rod shift step motor 36. Step motor 36, step motor 14, and electromagnets 22 are all electrically connected to a sequence and data control unit 40 that controls the operation of printer 10.

Figure 2:
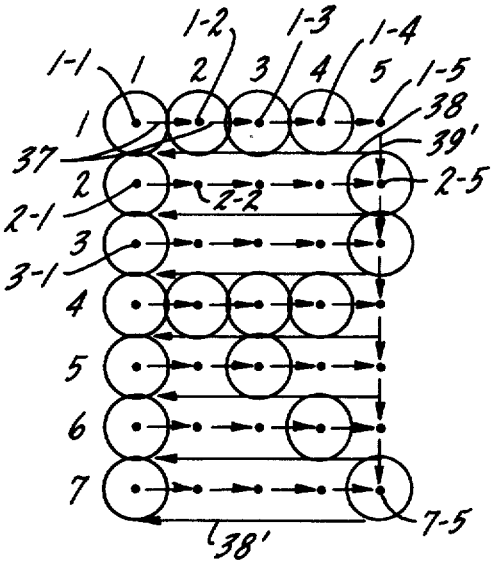
FIG. 2 is a matrix diagram illustrating the relative movements of the print elements and record sheet of the printer of FIG. 1.

FIG. 2 illustrates the manner in which a character, in this instance the letter "R", is printed by one of the print elements 17; a 5×7 matrix is assumed. The print element starts in alignment with the matrix position 1—1 (row 1, column 1); because a dot is required at this position, the electromagnet for that print rod is energized and drives the print rod into impact with the record sheet. The print rod is then restored to its initial position by the spring 28 (FIG. 1). After the first dot has been printed in the character, at matrix position 1-1 (FIG. 2), the print rod shift step motor 36 (FIG. 1) is energized to shift the print rod 17 in the direction of the arrow 37 (FIGS. 1 and 2) by one column-width increment. In fact, all of the print rods 17 are shifted simultaneously by operation of guide 31 of shift means 30. With the print rod now aligned with matrix position 1-2, FIG. 2, its associated electromagnet is again energized to print a dot at this position, since such a dot is required for the letter R. The print rod is then shifted another column-width increment to matrix position 1-3, another dot is printed, the print rod is deflected to matrix position 1-4, where another dot is printed, and the print element is then shifted to matrix position 1-5, at which no dot is required and none is printed.

From matrix position 1-5, the print element is next moved to matrix position 2-1. This requires two operations. The print rod shift step motor 36 (FIG. 1) is driven in reverse through a number of column-width increments to return the print rod to alignment with the initial column position of the matrix as indicated by arrow 38 (FIGS. 1 and 2). If forward movement of the print elements (arrows 37) stops at position 1-5, four increments of backward movement (arrow 38) are required. If a fifth forward incremental shift movement occurs, as in use of the control described hereinafter in conjunction with FIG. 3, a fifth increment of backward movement is employed. In addition, the paper feed step motor 14 is energized to rotate platen 11 and advance the record sheet 12 one row-width increment in the direction indicated by the arrow 38 in FIG. 1. This corresponds to a matrix movement as indicated by the arrow 39' in FIG. 2. For printing the second row of the matrix, FIG. 2, the actions described above for the printing of dots in the first row are repeated except that, in this instance, dots are printed only in matrix positions 2-1 and 2-5, since these are the only positions that require imprinting for the letter R. This procedure is followed through the entire 5×7 matrix shown in FIG. 2, ending with a final movement to bring the print element back into alignment with the initial column position as indicated by arrow 38'.

The described procedure prints a complete line 18 of characters 19 across record sheet 12. That is, in printing a line of characters each print element 17 is effectively moved, relative to record sheet 12, through all of the thirty-five matrix positions. Of course, the matrix can be varied; the total number of positions in any event is r·c, where r is the number of rows in the matrix and c is the number of columns. The incremental column shift movements and return movements are effected by shifting of print rod guide 31, whereas the incremental row shift movements are effected by rotation of platen 11 to advance record sheet 12.

FIG. 3 illustrates a sequence and data control system 40 constructed in accordance with a preferred embodiment of the present invention. Control system 40 has an input circuit 41 to which an input signal comprising a sequence of data words representing characters and auxiliary functions is applied. The specific form of the input signal is not critical; it may constitute virtually any conventional data signal for controlling teleprinters, data printout devices, and the like. For the purposes of this specification, the term "characters" includes any alpha/numeric characters or other special symbols to be printed and also blank spaces in the line of text. Auxiliary functions represented by other data words may include a carriage return code or other code indicative of the end of a line of characters, a line feed code, a bell code, font-change codes, and others. For convenience, it may be assumed that the data signal supplied to input 41 utilizes the American Standard Code for Information Interchange (ASCII), but it should be recognized that any other appropriate code can be employed.

Input circuit 41 is connected to a serial-parallel converter circuit 42. Whenever the input signal is in serial-by-bit form, as in the ASCII code, the converter 42 is required. For an input in the form of parallel bits, no serial-parallel converter is needed. In either case, the input presents the data signal to control unit 40 on a serial-by-character basis.

The output circuits 44 of converter 42 are coupled to the input stage of a main data store 43. Eight circuit connections 44 are shown from converter 42 to the input stage of store 43, one channel for each level of the ASCII input code plus a control level which is switched to the mark state for each spacing character. The capacity of main store 43 must be at least one full line of characters to be printed; preferably, store 43 has a capacity of at least several lines.

The output stage of main store 43 is connected to the input stage of a single-line first-in, first-out (FIFO) data store 46, to an end-of-line detector 47, and to an auxiliary function detector unit 48. Store 46 has a capacity sufficient to store the data words representative of one line 18 of characters to be printed on record sheet 12 (FIG. 1), including a reasonable number of auxiliary function codes relating to that line. Detector 47 is employed to identify any data word representative of the end of a line of printed characters; this may be a carriage return (CR) code in the ASCII code or other conventional teleprinter signal. Detectors 48 may be employed to identify any of a variety of different auxiliary function codes, particularly a line feed (LF) code.

The output stage of the single line store 46 is connected to another end-of-line (CR) detector 49, an additional auxiliary function detector unit 51, and a character signal generator 52. In system 40, it is assumed that store 46 is an eight-level shift register; the output stage of the store also has a recirculation connection back to the input stage for reasons discussed below. The detectors in unit 51 are utilized to identify any data words representative of auxiliary functions. Character signal generator 52 constitutes a read-only memory (ROM) for translating data words representative of spacing characters into dot position signals as required for control of the dot matrix printer.

Control 40 includes a column scan circuit 54 having five output circuits 53 connected to character signal generator 52. Circuit 54 is functionally illustrated as if it were a rotary scanning switch, but the construction employed is actually that of an electronic stepper or counter circuit affording a similar scanning action. The purpose of column scan circuit 54 is to limit the operation of character signal generator 52, at any given time, to the output signals corresponding to just one column of the five dot matrix columns. However, scanner 54 has an additional stage including an output 53-6 used for other control purposes as described below.

With this limitation, for a 5×7 matrix, character signal generator 52 has just seven data outputs 55 instead of thirty-five. These seven data outputs 55 are connected to a row scan circuit 56, again functionally illustrated as if it were a rotary selector switch but actually constituting an electronic counter circuit of generally equivalent operation. Scanner 56 includes an eighth stage with an output connection 55-8 used for control purposes described below. The dot position signals from character generator 52 are brought down, in scanner 56, to a single dot position output circuit 58, which is connected to the data input 59 of a line scan circuit 61.

Line scan circuit 61 is again shown as if it were a rotary selector switch having an output terminal for each print element in the printer. Assuming an eighty character line for the printer, line scan circuit 61 is actually provided with eighty-one (n+1) outputs 62. The first eighty stages of line scan circuit 61 are individually connected, through a series of driver amplifiers 64, to the electromagnets 22 in the print element actuators of the printer. Like the column and row scan circuits 54 and 56, line scan circuit 61 is constructed as an electronic sequencing circuit and not as an electromechanical selector switch.

Control unit 40, as illustrated in FIG. 3, includes a clock signal source 66 which generates a continuous flow of stepping pulses at a relatively high frequency, preferably about one thousand times the repeat rate for the electromagnets 22 employed for print element actuation. The output of clock source 66 is connected to one input of each of two AND gates 67 and 68. The output of gate 67 is connected to a clock or step input for main store 43. The output of gate 68 constitutes a stepping (CLK) input to single-line store 46. The output of gate 68 is also connected to one input of another AND gate 69, the second input to gate 69 being derived from the auxiliary function detector unit 51. The output of gate 69 affords a scan advance (clock) input to line scan circuit 61. Detectors 47 and 49, OR gate 76, flip-flop 77, and AND gates 68 and 69 thus comprise a line sequence control for controlling readout of data words from store 46 to character generator 52 and advancement of line scan circuit 61, as described more fully below.

The final (n+1) output 62 of line scan circuit 61, which is not connected to any of the print element actuators, comprises a column scan control circuit 72. Circuit 72 is connected to a "forward" input of a print element shift control circuit 71 that is connected to two driver amplifiers 73 in turn connected to the reversible step motor 36 employed for print element shift movements. Column scan control circuit 72 is also connected, through a delay circuit 74, to an advance (CLK) input for column scan circuit 54 and to a reset input for line scan circuit 61. The output of delay circuit 74 is also connected to one input of an OR gate 76 having a second input derived from the end-of-line detector 47. OR gate 76 is connected to the set input of a flip-flop 77 having an output that constitutes the second input to AND gate 68. The reset input to flip-flop 77 is derived from the end-of-line detector 49.

As noted above, row scan circuit 56 has r+1 stages, one more stage than the seven required for the individual rows in a 5×7 matrix. The eighth stage of row scan device 56 is connected to a line start control circuit 55-8 that is connected to one input of a paper feed control circuit 79; control 79 actuates the paper feed step motor 14 through a driver amplifier 81. The line start control circuit 55-8 is also connected to a delay circuit 82 that is connected back to a reset input for the row scan circuit. The output of delay circuit 82 is also connected to a clearing input of the single-line store 46. The output of delay circuit 82 further provides a set input, through a further delay circuit 87, to a flip-flop 85 having an output that constitutes the second input to AND gate 67. The reset input to flip-flop 85 is taken from end-of-line detector 47.

The sixth (c+1) output 53-6 of column scan circuit 54 comprises a row scan control circuit that is connected to an advance (CLK) input for row scan circuit 56 and to a second input for paper feed control circuit 79. The row scan control circuit 53-6 is further connected to a reversing input for print element shift control circuit 71 and to a delay circuit 84. The output of delay circuit 84 affords a reset input to circuit 54.

One of the outputs from auxiliary function detector unit 48 is a line feed (LF) signal. The line feed output of unit 48 is connected as a third input to paper feed control circuit 79.

Assuming that the input signal on line 41 is an ASCII signal, the received serial-by-bit data words are converted to parallel form in converter 42 and supplied, sequentially by character, to the input stage of the main store 43. As noted above, the input to store 43 includes a control level which is switched to the "mark" state for each input character. Clock pulses supplied to store 43 from source 66 through gate 67 advance the data words through store 43 and from the output stage of store 43 into the input stage of store 46. Gate 67 is enabled by a signal from flip-flop 85 upon completion of a previous line of printed characters, as described below. Gate 67 passes clock stepping pulses to the output stage of store 43 and continues the transfer of the data words relating to a new line of characters into store 46 until an end-of-line (CR) code is recognized by detector 47. Upon detection of the end-of-line code, a reset signal is applied to flip-flop 85, cutting off the enabling signal to gate 67 and stopping the transfer of data words from main store 43 to single-line store 46.

The end-of-line output signal from detector 47 is also applied to the set input of flip-flop 77, through OR gate 76, providing an enabling input to gate 68. With gate 68 thus enabled, clock pulses from source 66 are supplied to the FIFO single-line store 46 to initiate line-sequential application of the data words from the output stage of store 46 to the input of character signal generator 52. Each output code from store 46 is also supplied back to the input stage of the store, recirculating the data words representative of a single line through store 46. In character signal generator 52, the input is suppressed for vacant character positions in store 46, based on the additional control level noted above. The output of data words from store 46 to signal generator 52 stops when detector 49 recognizes an end-of-line (CR) code and supplies a reset signal to flip-flop 77 to interrupt the enabling signal to gate 68.

As the data words for the full line of printing are sequentially presented to character signal generator 52 from the single-line FIFO store 46, printing starts with the scanning circuits 54, 56 and 61 in the operating conditions indicated in FIG. 3. Thus, the first dot position output signal from signal generator 52 indicates the state of the matrix position 1-1 (FIG. 2) for the first character to be printed in line 18 (FIG. 1) and is supplied to the electromagnet 22 for the first print element 17. A dot is printed at the 1-1 matrix position if required for the letter to be reproduced at the extreme left-hand end of the line; for the letter R, shown at this position in FIGS. 1 and 2, the dot is printed.

The next clock pulse output from gate 68 (FIG. 3) supplies the next character data word to signal generator 52 from store 46; the same clock pulse is applied to line scan circuit 61 through gate 69, which normally receives an enabling signal from detector unit 51. This pulse advances the line scan circuit one stage. The second data word is decoded by character signal generator 52 and produces an output on line 58, through row scan circuit 56, that indicates whether or not a dot must be printed in the 1-1 matrix position for the second character in the print line. That dot position signal is supplied to the second print element actuator electromagnet 22. This procedure is repeated, with a new data word being supplied to character signal generator 52 and line scan circuit 61 advancing one stage in each cycle, until all of the required dots in the 1-1 matrix positions have been printed for the entire print line 18 (FIG. 1).

The last data word in single-line store 46 is an end-of-line code, which is identified by detector 49. That code occurs as the line scan circuit 61 advances to its final stage. At this point, the enabling input to AND gate 68 is interrupted because flip-flop 77 is reset from detector 49. Furthermore, a forward input signal is supplied to print element shift control 71 from the final (n + 1) stage of line scan circuit 61, actuating step motor 36 to shift print element guide 31 one column increment in the direction of arrow 37, (FIGS. 1 and 2), in preparation for printing the dot elements at the matrix positions 1-2.

After an appropriate brief delay, sufficient to assure completion of the incremental column shift movement of the print elements, a signal from delay circuit 74 (FIG. 3) is supplied to column scan circuit 54 to step that circuit by one stage. That signal is also applied to the set input of flip-flop 77 through OR gate 76 to again enable gate 68. This initiates a second application of the data words from single-line store 46, which have been recirculated back into the store, to character generator 52 for printing of those dots required for the individual characters in the line at matrix positions 1-2. This procedure is followed through matrix positions 1-3, 1-4, and 1-5 (FIG. 2) to complete the printing for all of the columns in the first row of the matrix for all of the characters in the line.

When printing a matrix position 1-5 has been completed, and line scan circuit 61 again steps to its final output stage (FIG. 3), the output signal from delay circuit 74 supplied to the clock or advance input of column scan circuit 54 steps the column scan circuit to its sixth and final stage. As a consequence, a clock or advance signal is supplied, via circuit 53-6, to the row scan circuit 56 to step that circuit to its second stage. This signal is also supplied to paper feed control 79, which pulses step motor 14, through driver 81, causing the paper feed step motor to advance the record sheet by the one row increment to permit printing of matrix row 2 (FIG. 2). The same output signal from column scan circuit 54 is applied to the print element shift control 71 as a reversing signal; in response, control 71 energizes motor 36 for reverse movement back to the initial column position of the matrix. Moreover, the completion-of-scan output signal from column scan circuit 54 is supplied, through delay circuit 84, to the reset input of the column scan circuit 54 to shift that stepping circuit back to its first stage, corresponding to the first column in the matrix. The print elements and record sheet are thus re-positioned, ready to print in matrix position 2-1 (FIG. 2).

Printing of the second row of dots in the matrix for each character in the line is carried out in the same manner as the first row. Thus, with all of the print elements 17 aligned with matrix position 2-1 (FIG. 2) the data words representative of the line of characters being printed are supplied, in sequence, from the single-line store 46 (FIG. 3) to character generator 52 in response to clock signals applied to store 46 through AND gate 68, flip-flop 77 having been reset by the column scan control signal from the n + 1 output 72 of line scan circuit 61 through delay circuit 74 and OR gate 76. At this time, column scan circuit 54 is in its first position, row scan circuit 56 is in its second position, and line scan circuit 61 steps through its eighty (n) stages in synchronism with the application of data words to character signal generator 52, the line scan circuit being supplied with clock pulses for this purpose through gate 69.

When the end-of-line character in the stored data is identified by detector 49, flip-flop 77 is reset to remove the enabling signal to gate 68 and interrupt the supply of data words to character signal generator 52, also interrupting the stepping (clock) signal input to line scan circuit 61. At this point, line scan circuit 61 has been stepped to its final (n + 1) stage, producing an output signal on column scan circuit 72 that is supplied to print element shift control 71; control 71 actuates step motor 36 to advance the print elements one column width increment. That same column scan control signal, passed through delay circuit 74, is supplied to column scan circuit 54 to advance that circuit to its second stage. The same signal is applied to flip-flop 77 through OR gate 76 to actuate the flip-flop and restore the enabling signal to gate 68, initiating printing of the dots in the second column position 2-2 (FIG. 2).

In this manner, the print elements are stepped through each of the dot matrix positions in the second row and all of the required dots are printed in all of the characters for these matrix positions. When the fifth column in the second row has been printed, and column scan circuit 54 steps to its final (c + 1) stage, an output signal on line 53-6 is supplied to the row scan circuit 56, the paper feed control 79, the print element shift control 71, and the delay circuit 84 that is connected back to the reset input of column scan circuit 54. The row scan control signal on circuit 53-6 thus actuates system 40 to advance row scan circuit 56 one stage, to advance the record sheet by one row width increment, to shift the print elements back to the initial column position, and to reset the column scan circuit 54. The print elements and record sheet are thus repositioned, ready to print in matrix position 3-1, and control system 40 is conditioned for printing the third row in the matrix for each character. The operations of the printer and its control system continue, as described above, through the printing of the remaining fourth through seventh matrix rows.

Upon completion of the printing of the final matrix position 7-5 (FIG. 2) for the nth character, which completes the printing of the entire line of characters, line scan circuit 61 advances one more step to its n + 1 stage and again produces an output signal on the column scan control circuit 72. That signal, as before, actuates the print element shift control 71, column scan circuit 54, and line scan circuit 61 to shift the print elements forward one column increment, advance column scan circuit 54 through its final (c + 1) stage, and reset line scan circuit 61. With column scan circuit 54 advanced to its final stage, an output signal is developed on row scan control circuit 53-6 and is applied to sheet feed control 79, print element shift control 71, row scan circuit 56, and column scan circuit 54, actuating those circuits to advance the record sheet one row increment, shift the print elements back to the initial column position, reset column scan circuit 54, and advance row scan circuit 56 to its final (r + 1) stage. Since row scan circuit 56 is now advanced to its final stage, an output signal is developed on line start control circuit 55-8 and is supplied to sheet feed control 79, single line store 46, flip-flop 85, and row scan circuit 56.

The line start control signal actuates paper feed control 79, supplying a predetermined number of pulse signals to the paper feed step motor 14, through amplifier 81, to advance the record sheet through a line feed space. Usually, the line feed space is at least three or four steps of the step motor, assuming one step to constitute a row width increment. The line start control signal from circuit 55-8 resets row scan circuit 56 to its initial stage. The same signal is applied to the "clear" input of store 46 to clear that storage register. Finally, after additional delay in circuit 87, the line start control signal from circuit 55-8 sets flip-flop 85 to supply an enabling signal to AND gate 67 and initiate the transfer of data words representative of a new line of characters from main store 43 to single line store 46. It will be recognized that this series of operations conditions the printer for printing of a new line of characters, which proceeds as described above.

Auxiliary function codes included in the input to control system 40 (FIG. 3) do not upset the necessary synchronism between the readout of data words representing characters to the character signal generator 52 and the advancement of line scan circuit 61. Any data word representative of a non-print function is detected by the circuits of unit 51 and interrupts the normal enabling signal supplied to AND gate 69 in the line sequence control that supplies clock signals to line scan circuit 61. Thus, line scan circuit 61 is not advanced by a clock pulse coincident with a data word that does not represent a character. At the same time, the auxiliary function codes are ignored in character signal generator 52, based on the added control level in the code referred to above. The auxiliary function data words are also detected in circuit 48 for such purposes as actuating a bell, or the like.

The data input to system 40 may include separate line feed codes to obtain additional spacing between lines of characters. Any line feed data word is identified in circuit 48 and provides an output signal, on line 88, that is supplied to paper feed control 79. This signal actuates paper feed control 79 to supply a predetermined number of pulses to step motor 14 to advance the record sheet by a line space.

Figure 4:
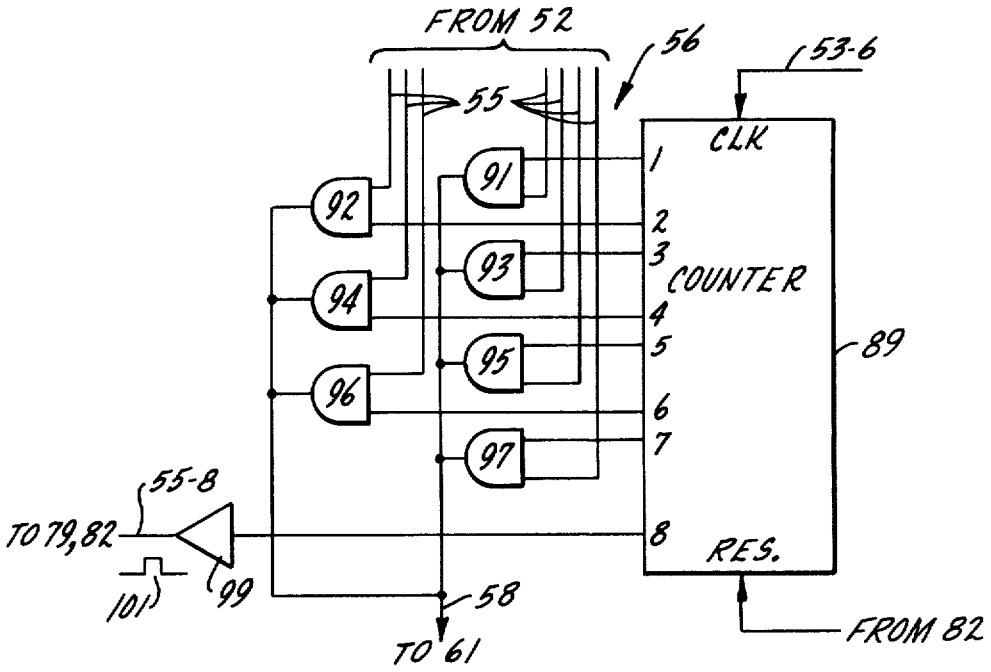
FIG. 4 is a logic diagram of a row scan circuit used in FIG. 3.

FIG. 4 illustrates a construction that may be employed for row scan circuit 56; the same type of circuit is readily adaptable to column scan circuit 54 and line scan circuit 61. As shown in FIG. 4, row scan circuit 56 may comprise a conventional electronic counter 89 of eight (r+1) stages having a stepping (CLK) input derived from the row scan control circuit 53-6 and having a reset input derived from the delay circuit 82 in the line start control circuit 55-8 (FIG. 3). Counter 89 has eight output terminals; the first seven output terminals are each connected to one input of a series of AND gates 91-97. The second input to each of these AND gates is one of the seven output leads 55 from character signal generator 52. The outputs of all of the AND gates 91-97 are connected together to the one output circuit 58 that supplies dot position signals to line scan circuit 61.

The remaining eighth (r+1) output terminal of counter 89 is connected to a Schmitt trigger or other pulse-forming circuit 99 having its output connected to the line start control circuit 55-8. In operation, counter 89 steps from its first stage to its eighth stage in response to row scan control signals supplied from circuit 53-6. When it reaches the final (r+1) stage, an input signal is applied to Schmitt trigger 99, which generates a pulse signal 101 employed for line start control purposes. Whenever counter 89 is actuated to any stage other than the final stage, it supplies a continuous enabling signal to one of the AND gates 91-97 so that the particular gate which is enabled will pass dot position signals from character signal generator 52 to line scan circuit 61.

No specific circuit has been illustrated for line scan device 61 because that circuit can be essentially similar to circuit 56, FIG. 4. Thus, line scan device 61 may be constructed as an electronic counter having eighty-one (n+1) stages. The first eighty stages of the counter may be each connected to one input of a corresponding AND gate, the AND gate for each stage having a second input derived from the dot position signal circuit 58. The output of each AND gate is then connected to one of the driver amplifiers 64 (FIG. 3). The final (n+1) stage of the counter is connected to a Schmitt trigger circuit or other pulse-forming circuit, just as in FIG. 4, and affords the column scan control output for circuit 72.

The column scan device 54 may be of even simpler construction, constituting simply an electronic counter of six (c+) stages. The first five (c) counter stages are connected directly to character signal generator 52. The final (c+1) stage is again connected to a Schmitt trigger or other pulse-forming circuit to provide the requisite row scan control signal for circuit 53-6.

It will be recognized that it is not really essential to have a final discrete +1 stage for the counters in the individual scan circuits 54, 56 and 61. Thus, referring to column scan circuit 54, the row scan control output for line 53-6 can be derived from the fifth (c) stage of the counter through a suitable delay circuit if desired. The same arrangement can be used for row scan circuit 56 and line scan circuit 61, taking the control output from the last (r or n) operating stage of the counter through an appropriate delay circuit. In effect, the delay circuit in each instance then constitutes an additional (+1) stage for the counter.

Furthermore, the interconnections between column scan circuit 54, character signal generator 52, and row scan circuit 56 are subject to other variations while maintaining the basic attributes of system 40. Thus, the two scan circuits can be reversed in relation to the character signal generator, with the rwo scan circuit supplying selective enabling inputs to the character signal generator and the column scan circuit employed for selective connection of the dot position signals to the single dot position output circuit 58. In another variation, the usual r·c outputs from character signal generator 52 may be utilized, with both column and row scan circuits coming after the character signal generator.

From the foregoing description, it will be apparent that the control system of the present invention provides highly accurate indexing movements of both the print elements 17 and the record sheet 12 (FIG. 1). Both are truly incremental movements effected by stepping motors, motor 14 for advancing record sheet 12 and motor 36 for column shifts of the print elements. There is no requirement for matching continuous movements of either the record sheet or the print rods with the timing of the print rod actuators 21, thus eliminating a substantial likelihood of character distortion from that source.

At the same time, the control system of the invention affords positive control from each column and row movement and operation for line printer 10. Thus, the clock signals that control the transmission of data words from single line store 46 to character signal generator 52 also directly control the step-by-step advancement of line scan circuit 61. Column scan circuit 54 is advanced only in response to a column scan control signal on line 72 that affords a positive indication that a line scan operation has been completed by circuit 61 and a new column position must be scanned. This same kind of positive control is applied to the operation of print element shift control 71 is advancing the print elements one column width interval at the end of each line scan.

The same level of positive control is also provided for row scan movements and operations. Thus, the advancement of record sheet 12 by one row increment is actuated only when column scan circuit 54 has counted to its c+1 level and produces an output signal on circuit 53-6. That same positive control signal advances row scan circuit 56 one stage and also actuates print element shift control 71 to return the print elements to the first column position, as well as resetting column scan circuit 54. Completion of a full line of characters is positively indicated by advancement of row scan circuit 56 to its final (r+1) stage, the resulting output signal on circuit 55-8 directly controlling the operations and movements necessary to the preparation of the printer for printing of a new line of characters.

Figure 2A:
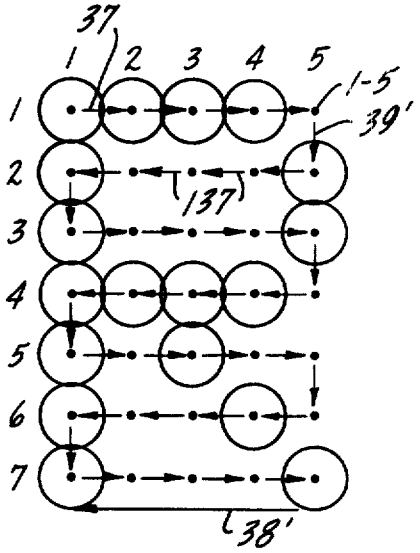
FIG. 2A is a diagram, similar to FIG. 2, of a modified pattern of relative movements between the print elements and the record sheet.

FIG. 2A illustrates a modified pattern that may be employed in the printing of the individual characters by line printer 10. In this arrangement, the first row of dots is printed in the same manner as described above, with the print elements being advanced by one column width increment, as indicated by arrows 37, each time a line scan is completed. From matrix position 1-5, however, there is no return of the print elements to the initial column position. Instead, only the row width incremental movement of the paper sheet (arrow 39') is provided and the second row of dots is printed in reverse through a series of column width incremental movements indicated by the arrows 137. This same pattern is followed in completing the scan of the entire matrix, and ends with a final return movement, arrow 38', to ready the printer for the next line of characters.

To achieve printing in the manner illustrated in FIG. 2A, it is necessary to modify control system 40 (FIG. 3) for certain reversing operations. Thus, line scan circuit 61 must comprise a reversible counter and this also true of column scan circuit 54; row scan circuit 56 requires no modification. In addition, for this modification of the system, the single-line store 46 preferably constitutes a random access memory with provision for reversing the sequence of readout for alternate rows in the printing operation. Of course, the logic circuitry requires some revision to afford appropriate sequencing of the operations of memory 46 and scan circuits 54 and 61, but those revisions are well within the capability of those of normal skill in the art.

I claim:

1. In a dot matrix line printer that prints characters in a dot matrix of c columns and r rows, utilizing an input signal comprising a sequence of data words representing characters and auxiliary functions, the printer comprising n dot print elements aligned with a record sheet at n spaced character positions along a print line, n print element actuators, bidirectional column shift means for shifting the print elements forward and backward through a predetermined range of column positions along the print line, a clock signal source, single-line storage means for storing a series of data words representative of a line of n characters, a character signal generator, connected to the output of the single-line storage means, for translating each data word representative of a character into r·c dot position signals, and row scan means and column scan means, connected to the character signal generator, for scanning the character signal generator to supply the dot position signals to a single output circuit in a predetermined line-row-column sequence;

an improved control system in which:

the row scan means comprises a counter having r+1 effective stages;

the column scan means comprises a counter having c+1 effective stages;

and the column shift means comprises incremental shift means for shifting the print elements by predetermined discrete column width steps;

the improved control system further comprising:

line scan means, comprising a counter having n+1 effective stages, for connecting the dot position signal output circuit to each print element actuator in line sequence;

incremental sheet feed means for feeding the record sheet transversely to the print line in predetermined row width increments;

line sequence control means for applying the clock signal to the single-line storage means and the line scan means to actuate those means to read out data words in line sequence from the single-line storage means to the character signal generator in synchronism width advancement of the line scan means by one stage for each data word representative of a character;

column scan control circuit means, connected to the line scan means, the column shift means, and the column scan means, for actuating those means to shift the print elements forward by one column increment, advance the column scan means one stage, and reset the line scan means each time the line scan means reaches an effective count of n+1;

row scan control circuit means connected to the column scan means, the sheet feed means, the column shift means, and the row scan means, for actuating those means to advance the record sheet one row increment, shift the print elements backward to the initial column position, advance the row scan means one stage, and reset the column scan means each time the column scan means reaches an effective count of c+1;

and line start control circuit means connected to the row scan means, the sheet feed means, and the single-line storage means, for actuating those means to advance the record sheet a predetermined number of row increments, clear the storage means, and reset the row scan means each time the row scan means reaches an effective count of r+1.

2. A control system for a dot matrix line printer according to claim 1, including a reversible step motor constituting the drive for the column shift means.

3. A control system for a dot matrix line printer, according to claim 1, in which the incremental sheet feed means comprises a step motor.

4. A control system for a dot matrix line printer, according to claim 1, and further comprising:

a main input storage means, comprising a FIFO store having a capacity of several lines of data words and having its output connected to the input of the single-line storage means;

and input control means, actuated by the line start control circuit means, for applying the clock signal to the main input storage means to transfer a series of data words representative of a line of n characters from the main input storage means to the single-line storage means when the row scan means reaches a count of r+1.

5. A control system for a dot matrix line printer, according to claim 4, in which the input control means comprises:

an end-of-line detector connected to the output of the main input storage means;

an AND gate having one input connected to the clock signal source, and a second input connected to a bistable control circuit, and an output connected to the main input storage means;

the bistable control circuit having a first actuating input connected to the line start control circuit means and an opposite actuating input connected to the end-of-line detector, so that a line start control signal actuates the bistable control circuit to one operating condition to supply an enabling signal to the AND gate and an end-to-line signal actuates the bistable control circuit to an opposite operating condition to interrupt that enabling signal.

6. A control system for a dot matrix line printer, according to claim 1, in which the line sequence control comprises:

an end-to-line detector connected to the output of the single-line storage means;

an AND gate having one input connected to the clock signal source, a second input connected to a bistable control circuit, and an output connected to the single-line storage means;

the bistable control circuit having a first actuating input connected to the column scan control circuit means and an opposite actuating input connected to the end-of-line detector, so that a column scan control signal actuates the bistable control circuit to one operating condition to supply an enabling signal to the AND gate and an end-of-line signal actuates the bistable control circuit to an opposite operating condition to interrupt that enabling signal.

* * * * *